United States Patent [19]

Prough

[11] Patent Number: 4,743,338

[45] Date of Patent: May 10, 1988

[54] METHOD OF REMOVING AIR FROM LIGNOCELLULOSIC MATERIAL BY PASSING THE MATERIAL THROUGH CONDUIT PATHS OF DIFFERENT DIAMETERS

[75] Inventor: Robert J. Prough, Glens Falls, N.Y.

[73] Assignee: Kamyr, Inc., Glens Falls, N.Y.

[21] Appl. No.: 864,219

[22] Filed: May 19, 1986

[51] Int. Cl.[4] ..... D21B 1/02; D21C 1/10

[52] U.S. Cl. ..... 162/25; 55/43; 55/55; 162/40; 162/56; 162/83

[58] Field of Search ..... 55/43, 55; 162/53, 56, 162/380, 50, 18, 71, 47, 57, 83, 24, 25, 26, 19, 40, 52

[56] References Cited

U.S. PATENT DOCUMENTS

| | | | |
|---|---|---|---|
| 2,975,096 | 3/1961 | Ginaven et al. | 162/18 |
| 3,007,542 | 11/1961 | Giampapa et al. | 55/55 |
| 4,198,266 | 4/1980 | Kirk et al. | 162/65 |
| 4,244,778 | 1/1981 | Lindahl et al. | 162/76 |
| 4,411,737 | 10/1983 | Galeano | 162/83 |
| 4,537,655 | 8/1985 | Henriksson et al. | 162/47 |

FOREIGN PATENT DOCUMENTS

| | | | |
|---|---|---|---|
| 962410 | 7/1964 | United Kingdom | 162/18 |

*Primary Examiner*—Steve Alvo
*Attorney, Agent, or Firm*—Nixon & Vanderhye

[57] ABSTRACT

Air is removed from wood chips, and they are impregnated by treatment liquid, in a process that is an alternative to presteaming and is particularly applicable to environments where presteaming is undesirable, such as in the sulphite treatment of chips during the production of mechanical pulp. The chips are passed in a continuous manner in a generally serpentine, vertically oriented path so that the chips are subjected to a pressure build-up pulsation as they move downwardly, and a pressure release pulsation as they move upwardly. The diameters or cross-sectional areas of the conduit portions defining the upward and downward portions of the path are controlled so that there is about twice the residence time during pressure build-up than there is during pressure release. A high pressure feeder and pump with a fly wheel are operatively connected to one end of the serpentine path, while an in-line drainer and other apparatus are connected to the other end. When mechanical pulp is being produced sulphite treatment liquid entrains the chips during movement in the serpentine path, and after passing through the drainer the chips pass to a refiner where they are ground to produce pulp.

9 Claims, 1 Drawing Sheet

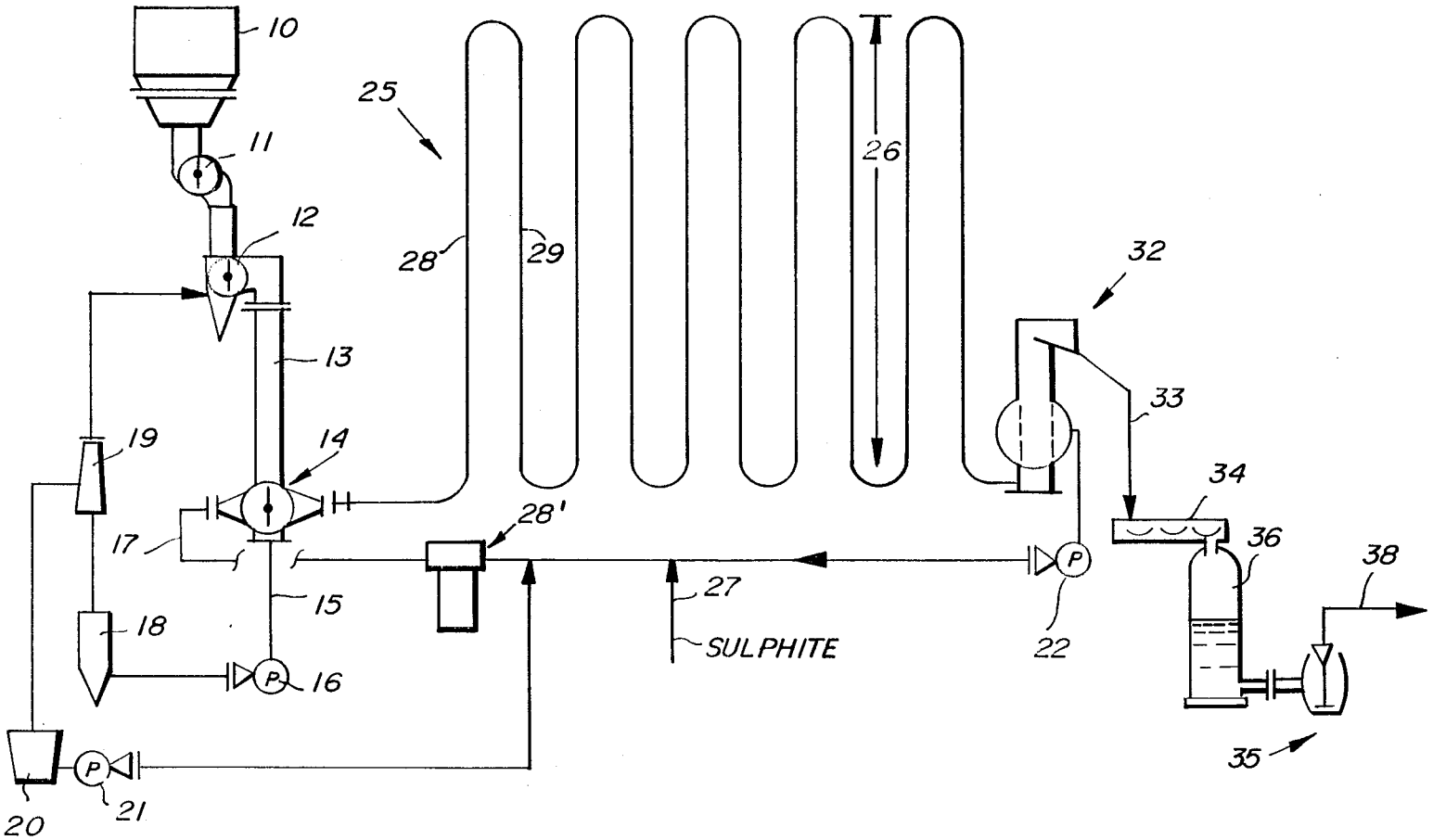
10
11
12
13
14
15
16
17
18
19
20
21
22
25
26
27
28
28'
29
32
33
34
35
36
38
SULPHITE

METHOD OF REMOVING AIR FROM LIGNOCELLULOSIC MATERIAL BY PASSING THE MATERIAL THROUGH CONDUIT PATHS OF DIFFERENT DIAMETERS

BACKGROUND AND SUMMARY OF THE INVENTION

In all pulping processes in which there is some chemical treatment of comminuted cellulosic fibrous material (such as wood chips), it is necessary to impregnate the chips with treatment liquid in order for the treatment to be effective. In order for uniform treatment to be possible, however, it is necessary to remove much of the air which is contained within the wood chips, since the air acts as a barrier to chemical diffusion. This is commonly dealt with in many pulping processes by steaming the chips to pretreat them, however there are some circumstances in which presteaming is undesirable. For instance in the production of mechanical pulps utilizing sulphite treatment, presteaming has a tendency to darken the final pulp produced therefore it should be avoided.

A pulping process called the Valamo method has been used on a laboratory scale and in a batch process in order to effect deaeration of the pulp (so that it may be impregnated) by subjecting it to cycles of pressure (for example 2–5 atmospheres). In this method, the submerged wood in a batch vessel is subjected to a pressure build-up cycle of about 10 seconds, and then a pressure release cycle of about 5 seconds. This effectively pumps the air out of the chips in about 5–6 cycles. While that procedure can be useful in removing air, it is difficult to assimilate with conventional continuous pulping processes, which is desirable for maximum commercialization.

According to the present invention a method and apparatus are provided which provide an alternative to presteaming for air removal during impregnation with treatment chemicals, and particularly a method and apparatus that can be useful as an alternative to presteaming in sulphite treatment during the production of mechanical pulps. According to the basic feature of the present invention, it is possible to continuously subject the wood chips. while entrained in treatment liquid (such as a sulphite liquid) to pressure pulsations to effectively pump the air out and impregnate the chips with chemicals.

The preferred manner in which the chips are deaerated and impregnated according to the present invention is by passing the chips up and down in a generally serpentine generally vertically oriented path so that the chips are subjected to continuous pressure build-up as they are moved downwardly, and continuous pressure release as they move upwardly. Typically the height of each leg of the path would be about 90 feet to achieve a desirable pressure change. Since it is desirable to provide a different time for pressure release than build-up during the alternating pressure pulsation cycles, the cross-sectional area of the serpentine conduit is controlled so that for the upwardly extending legs the area is significantly less (e.g. about half) of the cross-sectional area in the downwardly extending legs so that the pressure build-up leg residence time is about twice as great as the pressure release residence time.

The exemplary apparatus that is utilized according to the invention comprises a conventional high pressure feeder associated with a high pressure pump, the pump preferably being one having a fly wheel. Chips in a chute are led to the high pressure feeder, in which they are entrained with the treatment liquor (e.g. sulphite liquor during the production of mechanical pulp). The high pressure feeder is connected to a first end of the serpentine vertically extending path, while the opposite end thereof is connected to a drainer (which is operatively connected to the pump too), and the chips being discharged from the drainer pass to a screw, and then to a refiner.

Utilizing the invention it is possible to quickly, effectively, and simply deaerate chips, and impregnate them with treatment liquor, while avoiding the use of presteaming, and in a continuous manner.

BRIEF DESCRIPTION OF THE DRAWING

The drawing is a schematic representation of one form of exemplary apparatus according to the present invention can take.

DETAILED DESCRIPTION OF THE DRAWING

For ease of description, the invention will be described with respect to the apparatus illustrated in the drawing, and with respect to the treatment of wood chips with sulphite liquor during the production of mechanical pulp. However it is to be understood that the invention has broader applicability and is not limited to the specific apparatus illustrated, can be used in the treatment of other comminuted cellulosic fibrous material besides wood chips, and can be used in a wide variety of pulping processes aside from sulphite treatment prior to mechanical pulp formation.

The chips are fed to a conventional chips bin 10 and from there through a chips meter 11 to a low pressure valve 12 operatively connected to a vertically extending chute 13. At the bottom of the chute is a conventional high pressure feeder 14 of the type having a rotary element with a plurality of through-extending pockets, and screen means, and a motor for rotating the rotary element so that in one position thereof chips entrained in liquid passing from the chute 13 pass into a through-extending pocket, a large percentage of the entraining liquid passes through a screen to the low pressure discharge line 15 under the influence of low pressure pump 16 while the chips remain in the pocket, and then as the pocket is rotated into operative association with the high pressure line 17 the chips are discharged out of the feeder 14. Such a high pressure feeder is shown schematically in U.S. Pat. Nos. 3,802,956 and 4,123,318, and is sold by Kamyr, Inc. of Glens Falls, New York and Kamyr AB of Karlstad, Sweden.

In the low pressure line associated with the feeder 14 is an intermediate vessel 18, and an in-line drainer 19. Liquid which passes out of the drainer 19 passes to the level control tank 20 (which controls the level of liquid in the chute 13), and then is subsequently pumped by pump 21 to the high pressure line 17. A high pressure pump 22, preferably one with a fly wheel so that the line with which it is associated can empty itself when the pump motor goes down, is connected to the high pressure line 17 and provides the motive force for flushing the chips out of the high pressure feeder 14 into the deaeration-impregnation means 25.

The liquid in the high pressure line 17 preferably is treatment liquid for entraining the chips during the impregnation action thereon. In the preferred embodiment described, sulphite liquor is added by line 27 to the high pressure line 17, and an in-direct heater 28' may be provided for heating the treatment liquor.

The deaeration and impregnation means 25 comprises means for continuously subjecting the chips entrained in impregnation liquor to pressure build-up and pressure release pulsations. Preferably, the residence time of the chips during each pressure build-up pulsation is about twice as long (e.g. 10 seconds) as the residence time during the pressure release pulsations (e.g. 5 seconds).

The preferred form of the apparatus 25 illustrated in the drawings comprises a continuous conduit which extends in a generally serpentine manner, and has a generally vertical orientation, with a height differential 26 between the topmost and lowermost points of each leg of approximately 90 feet. Preferably at least five sets of pressure pulsation legs (that is a pressure build-up leg and a pressure release leg) are provided so that the chips are subjected to at least five pressure pulsation cycles so as to pump the air out of the chips and allow the treatment liquid to diffuse into the chips structure.

The preferred way in which the residence time of the chips in each leg of the pressure build-up pulsation is made less than the pressure release pulsation is by providing the upwardly extending conduit portions of a different cross-sectional area than the downwardly extending conduit portions. For instance in each pair of legs (each pair of legs providing one complete cycle of a pressure build-up pulsation and pressure release pulsation) has an upwardly extending portion 28 in which the pressure is continuously decreasing, and a pressure build-up portion in which the pressure is continuously increasing. The cross-sectional area of each leg 28 is made so that it is significantly less than (e.g. about half of) that of the downwardly extending leg 29 so that the chips in entrained liquid will flow with approximately twice the velocity in the upwardly extending leg than in the downwardly extending leg. As one operative example according to the invention, each leg 28 comprises a pipe that is generally circular in cross-section and has a diameter of about 4.75 inches, while each leg 29 comprises a generally circular in cross-section pipe having a diameter of about 6.7 inches, the residence time in leg 28 being about 5 seconds, and the residence time in each leg 29 about 10 seconds.

Operatively connected to the opposite end of the means 25 as the high pressure feeder 14 is a drainer 32. Liquid which is removed from the drainer 32 provides the feed liquid for high pressure pump 22. The chips which are discharged from drainer 22 preferably pass into conduit 33, and then to suitable treatment apparatus before they are led to conventional refiner 35. A typical treatment apparatus may include a feed screw 34, and feed-tank 36. Mechanical pulp is discharged in line 38 from the refiner 35.

The invention is operable for a wide variety of pulp consistencies. When passing in the means 25 the consistency of the chips-liquid slurry could be about 8–12 percent, and the slurry would be dewatered significantly in drainer 32 (and subsequent apparatus) so that it had a much higher consistency, for example on the order of that conventionally used as the feed consistency of slurry to a conventional refiner. Depending upon the particular impregnation liquor, and subsequent processing, the consistency could vary a lot widely as could the impregnation liquor, temperatures, actual pressure differential to which the chips are subjected during pressure pulsations, and the like.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent methods and apparatus.

What is claimed is:

1. A method of removing air from comminuted cellulosic fibrous material in a continuous manner, comprising the steps of:

(a) continuously passing the material, entrained in liquid, in a plurality of vertically disposed paths so that the material is subjected to varying pressure pulsations as it moves up and down in the vertically disposed paths;

(b) controlling the residence time of the material in the paths so that the residence time during each pressure build-up pulsation is greater than it is during each pressure reduction pulsation, so that the air is pumped out of the material, step (b) being practiced by controlling the diameter of a conduit in which the material passes in said vertical paths so that the cross-sectional area of the conduit is significantly greater in the portions thereof where the material is passing downwardly than in the portions thereof where the material is passing upwardly; and steps (a) and (b) being practiced so that the material is subjected to at least five pressure pulsation build-up and reduction cycles.

2. A method as recited in claim 1 wherein the residence time of the material in each pressure build-up cycle is approximately twice as great as the residence time in each pressure reduction pulsation.

3. A method as recited in claim 1 comprising the further steps, after step (b), of removing liquid from the material entrained in liquid, recycling the removed liquid to entrain other comminuted cellulosic fibrous material prior to the practice of step (a), and adding sulphite treatment liquid to the removed and recirculated liquid.

4. A method as recited in claim 1 wherein the step (a) is practiced so that the vertical length of each of the vertically disposed paths is on the order of about 90 feet.

5. A method of impregnating cellulosic fibrous material, which has air contained therein, with treatment liquid, in a continuous manner, comprising the steps of:

(a) continuously passing the material, in treatment liquid, in a plurality of cyclical up and down paths so that the material is subjected to pressure build-up and reduction pulsations as it moves up and down;

(b) controlling the residence time of the material in the paths so that the residence time is significantly greater during each pressure build-up pulsation than it is during each pressure reduction pulsation, so that the air is pumped out of the material and so that the material is impregnated with the treatment liquid in which it is entrained; and said controlling being practiced by controlling the diameter of a conduit in which the material passes in said vertical paths so that the cross-sectional area of the conduit is significantly greater in the portions thereof where the material is passing downwardly than in the portions thereof where the material is passing upwardly; and steps (a) and (b) being practiced so that the material is subjected to at least five pressure pulsation build-up and reduction cycles.

6. A method as recited in claim 5 wherein the residence time of the material in each pressure build-up cycle is approximately twice as great as the residence time in each pressure reduction pulsation.

7. A method as recited in claim 5 wherein the entraining liquid is sulphite liquid, and comprising the further step (c), after steps (a) and (b), of (c) refining the material so as to produce a mechanical pulp.

8. A method as recited in claim 5 comprising the further steps, after step (b), of removing liquid from the material entrained in liquid, recycling the removed liquid to entrain other comminuted cellulosic fibrous material prior to the practice of step (a), and adding sulphite treatment liquid to the removed and recirculated liquid.

9. A method as recited in claim 5 wherein the step (a) is practiced so that the vertical length of each of the vertically disposed paths is on the order of about 90 feet.

* * * * *